US010916205B2

(12) United States Patent
Lee

(10) Patent No.: US 10,916,205 B2
(45) Date of Patent: Feb. 9, 2021

(54) DISPLAY DEVICE AND DRIVING METHOD THEREOF

(71) Applicant: Samsung Display Co., LTD., Yongin-si (KR)

(72) Inventor: Chang-Soo Lee, Suwon-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 16/568,755

(22) Filed: Sep. 12, 2019

(65) Prior Publication Data

US 2020/0234653 A1 Jul. 23, 2020

(30) Foreign Application Priority Data

Jan. 21, 2019 (KR) ..... 10-2019-0007794

(51) Int. Cl.
*G09G 3/3291* (2016.01)
*G09G 3/36* (2006.01)

(52) U.S. Cl.
CPC ..... *G09G 3/3291* (2013.01); *G09G 3/3688* (2013.01); *G09G 3/3696* (2013.01)

(58) Field of Classification Search
CPC .. G09G 3/3291; G09G 3/3696; G09G 3/3688; G09G 3/325; G09G 3/3648; G09G 3/3225; G09G 2340/16; G09G 2350/00; G09G 2320/0252; G09G 2310/08; G09G 2300/0819; G09G 2300/0842; G09G 2300/0814
See application file for complete search history.

(56) References Cited

U.S. PATENT DOCUMENTS

2008/0055289 A1* 3/2008 Kim ..... G09G 5/399 345/204
2016/0275852 A1* 9/2016 Hong ..... G09G 3/3648
2017/0047028 A1* 2/2017 Seo ..... G09G 3/3614

FOREIGN PATENT DOCUMENTS

JP 2007272179 10/2007
KR 1020060093591 8/2006
KR 1020170028479 3/2017
KR 1020180056488 5/2018

OTHER PUBLICATIONS

"White Paper", AMD Project Freesync, (Mar. 2014), pp. 1-7.

* cited by examiner

*Primary Examiner* — Brent D Castiaux
(74) *Attorney, Agent, or Firm* — Cantor Colburn LLP

(57) ABSTRACT

A display device includes a display unit which includes pixels and gate lines and data lines connected to the pixels, a data driver connected to the data lines, and a signal controller which outputs a first frequency data control signal to the data driver at a predetermined frame frequency and outputs a second frequency data control signal to the data driver in synchronization with a vertical synchronization signal received from a graphics processing unit, wherein the data driver outputs a first data voltage to the data lines in accordance with the first frequency data control signal, and stops the output of the first data voltage and outputs a second data voltage to the data lines when the second frequency data control signal is inputted while outputting the first data voltage to the data lines.

17 Claims, 6 Drawing Sheets

DISPLAY DEVICE AND DRIVING METHOD THEREOF

This application claims priority to Korean Patent Application No. 10-2019-0007794, filed on Jan. 21, 2019, and all the benefits accruing therefrom under 35 U.S.C. § 119, the content of which in its entirety is herein incorporated by reference.

BACKGROUND

(a) Field

Exemplary embodiments of the invention relate to a display device and a driving method thereof, and more particularly, to a display device having a variable frame frequency, and a driving method thereof.

(b) Description of the Related Art

A display device displays a number of frame images corresponding to a frame frequency per second. The display device may display a plurality of frame images at a predetermined frame frequency, or may display a plurality of frame images corresponding to a variable frame frequency.

The display device generally includes a display unit including a plurality of pixels and a signal controller for driving the display unit. The signal controller displays an image on a display unit by an image signal and an input control signal received from an external graphics processing unit. The graphics processing unit renders raw data to generate the image signal, and a rendering time for generating the image signal corresponding to one frame may vary depending on a type or characteristic of the image.

SUMMARY

When a rendering time becomes longer, a signal controller lowers a frame frequency in response to the rendering time. In this case, luminance of an image displayed in a display unit may be lowered. Conversely, a signal controller may increase the frame frequency in response to the rendering time, and in this case, the luminance of the image displayed in the display unit is increased. As such, when the frame frequency fluctuates, a phenomenon occurs in which the luminance of the image is increased or decreased, and this fluctuation of the image may cause a screen to appear to be flickering.

Exemplary embodiments of the invention has been made in an effort to provide a display device and a driving method thereof, capable of improving display quality by preventing luminance fluctuations that may occur as the frame frequency varies.

An exemplary embodiment of the invention provides a display device including a display unit which includes a plurality of pixels and a plurality of gate lines and a plurality of data lines connected to the plurality of pixels, a data driver connected to the plurality of data lines, and a signal controller which outputs a first frequency data control signal to the data driver at a predetermined frame frequency and outputs a second frequency data control signal to the data driver in synchronization with a vertical synchronization signal received from a graphics processing unit, where the data driver outputs a first data voltage to the plurality of data lines in accordance with the first frequency data control signal, and stops the output of the first data voltage and outputs a second data voltage to the plurality of data lines when the second frequency data control signal is inputted while outputting the first data voltage to the plurality of data lines.

In an exemplary embodiment, the predetermined frame frequency may be a highest frame frequency among variable frame frequencies.

In an exemplary embodiment, the first data voltage may be a data voltage corresponding to a previous frame, and the second data voltage may correspond to a current frame.

In an exemplary embodiment, the display unit may display a part of an image of the previous frame by the first data voltage, and then may display an image of the current frame by the second data voltage.

In an exemplary embodiment, a blank period in which no data is written may not be positioned between display of the part of the image of the previous frame and display of the image of the current frame, and the part of the image of the previous frame and the image of the current frame may be continuously displayed.

In an exemplary embodiment, the display device may further include a gate driver connected to the plurality of gate lines, the signal controller may output a first frequency gate control signal to the gate driver at a predetermined frame frequency and may output a second frequency gate control signal to the gate driver in synchronization with the vertical synchronization signal received from the graphics processing unit, and the gate driver may output a first gate signal to the plurality of gate lines in accordance with the first frequency gate control signal, and may stop the output of the first gate signal and output a second gate signal to the plurality of gate lines when the second frequency gate control signal is inputted while outputting the first gate signal to the plurality of gate lines.

In an exemplary embodiment, an exemplary embodiment of the invention provides a display device including a display unit including a plurality of pixels and a plurality of gate lines and a plurality of data lines connected to the plurality of pixels, a data driver connected to the plurality of data lines, a synchronization signal generator which outputs a first frequency data control signal to the data driver at a predetermined frame frequency, outputs a second frequency data control signal to the data driver in synchronization with a vertical synchronization signal received from a graphics processing unit, and generates a self-vertical synchronization signal at the predetermined frame frequency, a data generator which receives the vertical synchronization signal and the self-vertical synchronization signal from the synchronization signal generator, processes an image signal received from the graphics processing unit to generate an image data signal, and transfers the image data signal to the data driver, and a storage unit which stores the image data signal, where the data generator outputs an image data signal of a previous frame stored in the storage unit in synchronization with the vertical synchronization signal, and outputs an image data signal of a current frame in synchronization with the vertical synchronization signal, and a difference between an output time of the self-vertical synchronization signal and an output time of the vertical synchronization signal is smaller than a reference period in accordance with the predetermined frame frequency.

In an exemplary embodiment, the predetermined frame frequency may be a highest frame frequency among variable frame frequencies.

In an exemplary embodiment, the synchronization signal generator may generate the self-vertical synchronization signal with the predetermined frame frequency when the vertical synchronization signal is received at a frame frequency that is lower than the predetermined frame frequency.

In an exemplary embodiment, the data driver may output a first data voltage to the plurality of data lines in accordance with the first frequency data control signal, and may stop the output of the first data voltage and output a second data voltage to the plurality of data lines when the second frequency data control signal is inputted while outputting the first data voltage to the plurality of data lines.

In an exemplary embodiment, the first data voltage may be a data voltage corresponding to a previous frame, and the second data voltage may be a data voltage corresponding to a current frame.

In an exemplary embodiment, the display unit may display a part of an image of the previous frame by the first data voltage, and then may display an image of the current frame by the second data voltage.

In an exemplary embodiment, a blank period in which no data is written may not be positioned between display of the part of the image of the previous frame and display of the image of the current frame, and the part of the image of the previous frame and the image of the current frame may be continuously displayed.

In an exemplary embodiment, the display device may further include a gate driver connected to the plurality of gate lines, the signal controller may output a first frequency gate control signal to the gate driver at a predetermined frame frequency and may output a second frequency gate control signal to the gate driver in synchronization with the vertical synchronization signal received from the graphics processing unit, and the gate driver may output a first gate signal to the plurality of gate lines in accordance with the first frequency gate control signal, and may stop the output of the first gate signal and output a second gate signal to the plurality of gate lines when the second frequency gate control signal is inputted while outputting the first gate signal to the plurality of gate lines in accordance with the first frequency gate control signal.

In an exemplary embodiment, an exemplary embodiment of the invention provides a driving method of a display device including a display unit which includes a plurality of pixels and a plurality of gate lines and a plurality of data lines connected to the plurality of pixels, including allowing an image of a previous frame to be repeatedly displayed on the display unit at a predetermined frame frequency until a vertical synchronization signal is inputted from a graphics processing unit; and displaying an image of a current frame on the display unit in synchronization with the vertical synchronization signal after displaying a part of the image of the previous frame from a first gate line of the plurality of gate lines to a predetermined gate line of the plurality of gate lines.

In an exemplary embodiment, the vertical synchronization signal may be received at a frame frequency that is lower than the predetermined frame frequency.

In an exemplary embodiment, the predetermined frame frequency may be a highest frame frequency among variable frame frequencies.

In an exemplary embodiment, a blank period in which no data is written may not be positioned between display of the part of the image of the previous frame and display of the image of the current frame, and the part of the image of the previous frame and the image of the current frame may be continuously displayed.

In an exemplary embodiment, the allowing the image of the previous frame to be displayed on the display unit may include generating a self-vertical synchronization signal at the predetermined frame frequency; and outputting an image data signal of the previous frame stored in a storage unit in synchronization with the self-vertical synchronization signal.

In an exemplary embodiment, a first frequency data control signal may be applied to a data driver connected to the plurality of data lines at the predetermined frame frequency, the data driver may output a first data voltage in accordance with the first frequency data control signal, and the data driver may stop output of the first data voltage and may output a second data voltage to the plurality of data lines to display the image of the current frame when a second frequency data control signal synchronized with the vertical synchronization signal is applied to the data driver while outputting the first data voltage to the plurality of data lines.

According to the exemplary embodiments of the invention, it is possible to provide a display device and a driving method thereof, capable of improving display quality by preventing luminance fluctuations that may occur as the frame frequency varies.

BRIEF DESCRIPTION OF THE DRAWINGS

The above and other exemplary embodiments, advantages and features of this disclosure will become more apparent by describing in further detail exemplary embodiments thereof with reference to the accompanying drawings, in which.

DETAILED DESCRIPTION

Figure 1:
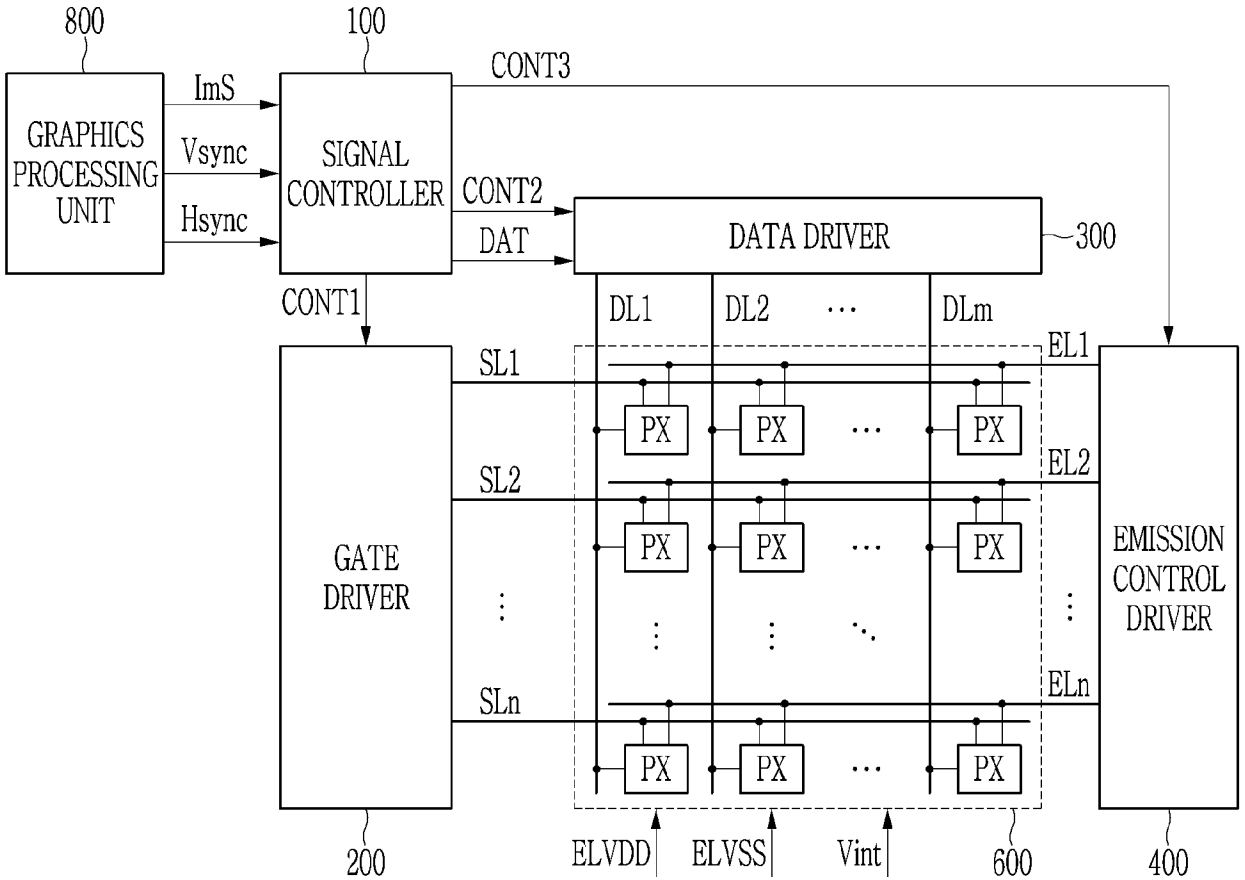
FIG. 1 is a block diagram schematically illustrating an exemplary embodiment of a display device according to the invention.

Exemplary embodiments of the invention will be described more fully hereinafter with reference to the accompanying drawings, in which exemplary embodiments of the invention are shown. As those skilled in the art would realize, the described embodiments may be modified in various different ways, all without departing from the spirit or scope of the invention.

Further, in the various exemplary embodiments, for components having the same configuration, like reference numerals are used and described only in one illustrative exemplary embodiment, and in other exemplary embodiments, only different configurations from the first exemplary embodiment will be described.

To clearly describe the invention, parts that are irrelevant to the description are omitted, and like numerals refer to like or similar constituent elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Hereinafter, an exemplary embodiment of a display device according to the invention will be described with reference to FIGS. 1 and 2.

FIG. 1 is a block diagram schematically illustrating an exemplary embodiment of a display device according to the invention.

Referring to FIG. 1, the display device includes a signal controller 100, a gate driver 200, a data driver 300, an emission control driver 400, a display unit 600, and a graphics processing unit 800. The display device may be an organic light emitting diode ("OLED") display or a liquid crystal display ("LCD"). When the display device is the LCD, the emission control driver 400 may be omitted. Hereinafter, the display device will be described as the OLED display, but the type of the display device is not limited.

The graphics processing unit 800 processes raw data in a manner such as rendering to generate an image signal ImS and an input control signal for controlling a display of the image signal ImS. The image signal ImS includes luminance information of each pixel PX, and the luminance includes a predetermined number of gray levels. The input control signal may include a vertical synchronization signal Vsync and a horizontal synchronization signal Hsync.

The signal controller 100 receives the image signal ImS and the input control signal from the graphics processing unit 800. The signal controller 100 divides the image signal ImS in units of frames depending on the vertical synchronization signal Vsync, and divides the image signal ImS in units of gate lines SL1 to SLn, where n is a natural number, depending on the horizontal synchronization signal Hsync. The signal controller 100 appropriately processes the image signal ImS on the basis of the image signal ImS and the input control signal in accordance with operating conditions of the display unit 600 and the data driver 300, to generate an image data signal DAT, a gate control signal CONT1, a data control signal CONT2, and an emission control signal CONT3. The gate control signal CONT1 may include a signal indicating the start of output of a gate signal. The data control signal CONT2 may include a signal indicating the start of output of a data voltage. The emission control signal CONT3 may include a signal indicating the start of output of an emission signal. The signal controller 100 transfers the gate control signal CONT1 to the gate driver 200. The signal controller 100 transfers the data control signal CONT2 and the image data signal DAT to the data driver 300. The signal controller 100 transfers the emission control signal CONT3 to the emission control driver 400.

The signal controller 100 may output the gate control signal CONT1, the data control signal CONT2, and the emission control signal CONT3 in synchronization with the vertical synchronization signal Vsync received from the graphics processing unit 800. In addition, the signal controller 100 may output the gate control signal CONT1, the data control signal CONT2, and the emission control signal CONT3 at a predetermined frame frequency. A detailed description thereof will be given later with reference to FIGS. 2 and 3.

The display unit 600 includes a plurality of gate lines SL1 to SLn, a plurality of data lines DL1 to DLm, a plurality of emission control lines EL1 to ELn, and a plurality of pixels PX, where m is a natural number. The pixels PX may be connected to the gate lines SL1 to SLn, the data lines DL1 to DLm, and the emission control lines EL1 to ELn, to be arranged in a matrix form. The gate lines SL1 to SLn extend substantially in a row direction to be substantially parallel to each other. The emission control lines EL1 to ELn extend substantially in the row direction to be substantially parallel to each other. The data lines DL1 to DLm extend substantially in the column direction to be substantially parallel to each other. A first power supply voltage ELVDD, a second power supply voltage ELVSS, and an initialization voltage Vint may be supplied to the display unit 600.

The gate driver 200 is connected to the gate lines SL1 to SLn, and supplies gate signals including a combination of a gate-on voltage and a gate-off voltage to the gate lines SL1 to SLn in accordance with the gate control signal CONT1. The gate driver 200 may sequentially apply the gate signals of the gate-on voltage to the gate lines SL1 to SLn.

The data driver 300 is connected to the data lines DL1 to DLm, samples and holds the image data signal DAT in accordance with the data control signal CONT2, and applies data voltages to the data lines DL1 to DLm. The data driver 300 may apply data voltages having a predetermined voltage range to the data lines DL1 to DLm in response to the gate signal of the gate-on voltage.

Hereinafter, the gate control signal CONT1 that is outputted by the signal controller 100 at a predetermined frame frequency is referred to as a first frequency gate control signal, and a gate signal that the gate driver 200 outputs to the gate lines SL1 to SLn in accordance with the first frequency gate control signal is referred to as a first gate signal. In addition, the gate control signal CONT1 outputted by the signal controller 100 in synchronization with the vertical synchronization signal Vsync received from the graphics processing unit 800 is referred to as a second frequency gate control signal, and a gate signal that the gate driver 200 outputs to the gate lines SL1 to SLn in accordance with the second frequency gate control signal is referred to as a second gate signal.

When the second frequency gate control signal is inputted from the signal controller 100 to the gate driver 200 while sequentially outputting the first gate signal to the gate lines SL1 to SLn, the gate driver 200 may stop the output of the first gate signal and sequentially output the second gate signal to the gate lines SL1 to SLn.

Hereinafter, the data control signal CONT2 that is outputted by the signal controller 100 at a predetermined frame frequency is referred to as a first frequency data control signal, and a data voltage that the data driver 300 outputs to the data lines DL1 to DLm in accordance with the first frequency data control signal is referred to as a first data voltage. In addition, the data control signal CONT2 outputted by the signal controller 100 in synchronization with the vertical synchronization signal Vsync received from the graphics processing unit 800 is referred to as a second frequency data control signal, and a data voltage that the data driver 300 outputs to the data lines DL1 to DLm in accordance with the second frequency data control signal is referred to as a second data voltage.

When the second frequency data control signal is inputted from the signal controller 100 to the data driver 300 while outputting the first data voltage to the data lines DL1 to DLm, the data driver 300 may stop the output of the first data voltage and output the second data voltage to the data lines DL1 to DLm. In this case, the first data voltage may be a data voltage corresponding to the image signal ImS of a previous frame, and the second data voltage may be a data voltage corresponding to the image signal ImS of a current frame.

The emission control driver 400 may be connected to the emission control lines EL1 to ELn to supply an emission signal including a combination of a gate-on voltage and a gate-off voltage to the emission control lines EL1 to ELn. The emission signal is applied to the pixels PX through the emission control lines EL1 to ELn.

Hereinafter, the emission control signal CONT3 that is outputted by the signal controller 100 at a predetermined frame frequency is referred to as a first frequency emission control signal, and an emission signal that the emission control driver 400 outputs to the emission control lines EL1 to ELn in accordance with the first frequency emission control signal is referred to as a first emission signal. In addition, the emission control signal CONT3 outputted by the signal controller 100 in synchronization with the vertical synchronization signal Vsync received from the graphics processing unit 800 is referred to as a second frequency emission control signal, and an emission signal that the emission control driver 400 outputs to the emission control lines EL1 to ELn in accordance with the second frequency emission control signal is referred to as a second emission signal.

When the second frequency emission control signal is inputted from the signal controller 100 to the emission control driver 400 while sequentially outputting the first emission signal to the emission control lines EL1 to ELn, the emission control driver 400 may stop the output of the first emission signal and sequentially or simultaneously output the second emission signal to the emission control lines EL1 to ELn.

Figure 2:
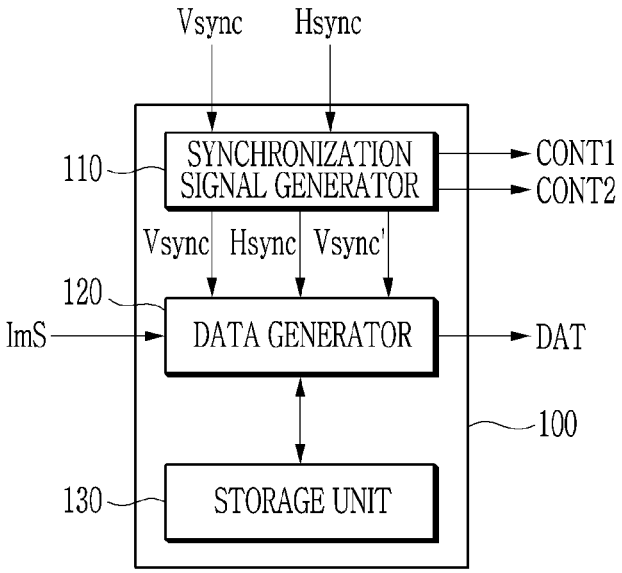
FIG. 2 illustrates a block diagram of an exemplary embodiment of a signal controller according to the invention.

FIG. 2 illustrates an exemplary embodiment of a block diagram of a signal controller according to the invention.

Referring to FIG. 2, the signal controller 100 includes a synchronization signal generator 110, a data generator 120, and a storage unit 130.

The synchronization signal generator 110 receives a vertical synchronization signal Vsync and a horizontal synchronization signal Hsync from the graphics processing unit 800 (refer to FIG. 1). The synchronization signal generator 110 may output the gate control signal CONT1 and the data control signal CONT2 in synchronization with the vertical synchronization signal Vsync. That is, the synchronization signal generator 110 may output the second frequency gate control signal and the second frequency data control signal.

When the vertical synchronization signal Vsync received from the graphics processing unit 800 is received at a lower frame frequency than a predetermined frame frequency, the synchronization signal generator 110 may generate the gate control signal CONT1 and the data control signal CONT2 at the predetermined frame frequency. That is, the synchronization signal generator 110 may output the first frequency gate control signal and the first frequency data control signal. The predetermined frame frequency may be a highest frame frequency among variable frame frequencies.

Although not illustrated in FIG. 2, the synchronization signal generator 110 may output the emission control signal CONT3 at a predetermined frame frequency when the vertical synchronization signal Vsync is received from the graphics processing unit 800 at a lower frame frequency than the predetermined frame frequency. In addition, the synchronization signal generator 110 may output the emission control signal CONT3 in synchronization with the vertical synchronization signal Vsync. That is, the synchronization signal generator 110 may output the first frequency emission control signal and the second frequency emission control signal.

The synchronization signal generator 110 transfer the vertical synchronization signal Vsync and the horizontal synchronization signal Hsync received from the graphics processing unit 800 to the data generator 120. The synchronization signal generator 110 generates a self-vertical synchronization signal Vsync' at a predetermined frame frequency to transfer it to the data generator 120.

The data generator 120 receives the image signal ImS, the vertical synchronization signal Vsync, the horizontal synchronization signal Hsync, and the self-vertical synchronization signal Vsync', to generate an image data signal DAT based on the received signals and transfer the image data signal DAT to the data driver 300 (refer to FIG. 1). The data generator 120 divides the image signal ImS in units of frames depending on the vertical synchronization signal Vsync, and divides the image signal ImS in units of gate lines SL1 to SLn depending on the horizontal synchronization signal Hsync, to generate the image data signal DAT. The data generator 120 may output the image data signal DAT in synchronization with the vertical synchronization signal Vsync. In an alternative exemplary embodiment, the data generator 120 may store the image data signal DAT of one frame generated based on the image signal ImS in the storage unit 130, and then may output the image data signal DAT stored in the storage unit 130 in a next frame. The data generator 120 may output the image data signal DAT stored in the storage unit 130 in synchronization with the self-vertical synchronization signal Vsync'.

The storage unit 130 stores the image data signal DAT generated by the data generator 120.

Hereinafter, an exemplary embodiment of a driving method of a display device according to the invention will be described with reference to FIG. 3 as well as FIGS. 1 and 2.

Figure 3:
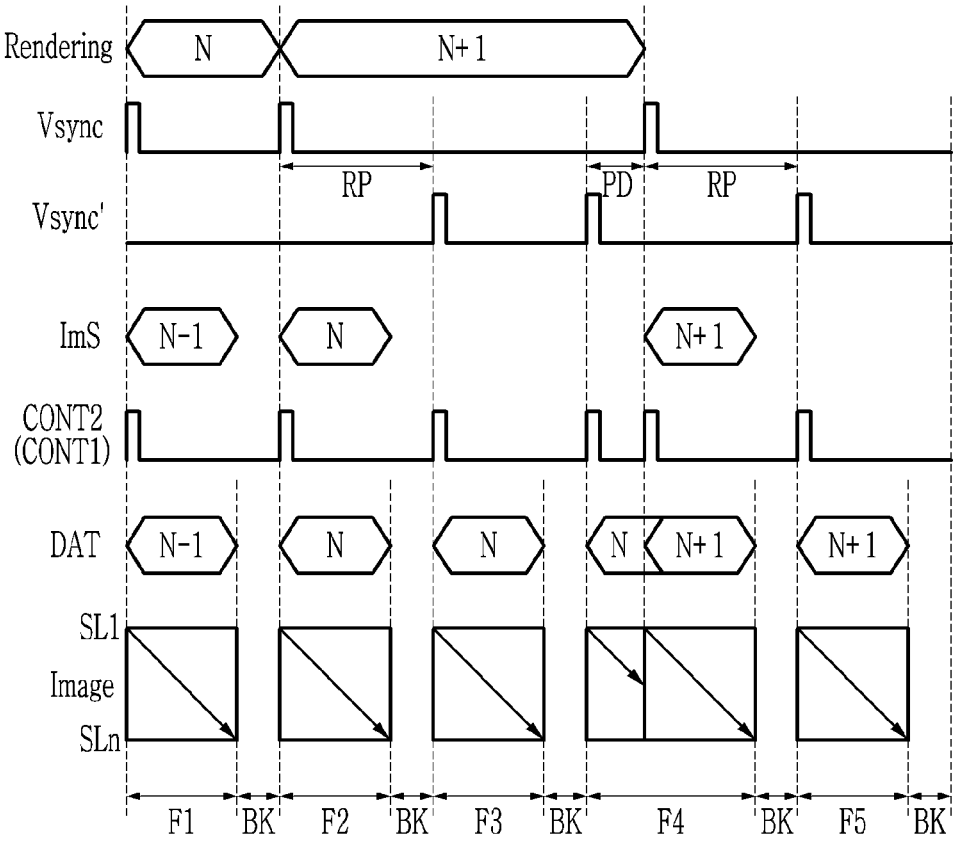
FIG. 3 illustrates a timing diagram showing an exemplary embodiment of a driving method of a display device according to the invention.

FIG. 3 illustrates an exemplary embodiment of a timing diagram showing a driving method of a display device according to the invention.

Referring to FIGS. 1 to 3, raw data is processed in the same manner as rendering in the graphics processing unit 800, and a time desired to generate the image signal ImS by processing the raw data corresponding to one frame may vary.

As illustrated in FIG. 3, a time desired to process the raw data corresponding to an $(N+1)^{th}$ frame may be longer than a time desired to process the raw data corresponding to an $N^{th}$ frame where N is a natural number. After completing the raw data processing corresponding to the $N^{th}$ frame, the graphics processing unit 800 transfer the corresponding image signal ImS to the signal controller 100 together with the vertical synchronization signal Vsync. After completing the raw data processing corresponding to the $(N+1)^{th}$ frame, the graphics processing unit 800 transfer the corresponding image signal ImS to the signal controller 100 together with the vertical synchronization signal Vsync. Accordingly, a frame frequency indicated by the vertical synchronization signal Vsync transferred from the graphics processing unit 800 to the signal controller 100 may vary. In an exemplary embodiment, the image signal ImS corresponding to the $N^{th}$ frame and the vertical synchronization signal Vsync are inputted to the signal controller 100 at a frame frequency of about 144 Hertz (Hz), whereas the image signal ImS corresponding to the $(N+1)^{th}$ frame and the vertical synchronization signal Vsync are inputted to the signal controller 100 at a frame frequency of about 60 Hz, for example.

The synchronization signal generator 110 of the signal controller 100 outputs the gate control signal CONT1 and the data control signal CONT2 in synchronization with the vertical synchronization signal Vsync received from the graphics processing unit 800, and transfers the vertical synchronization signal Vsync to the data generator 120. The data generator 120 may process the image signal ImS inputted together with the vertical synchronization signal Vsync to output the image data signal DAT. In this case, the data generator 120 may store the generated image data signal DAT in the storage unit 130.

In an exemplary embodiment, when the vertical synchronization signal Vsync is inputted to the signal controller 100 together with the image signal ImS corresponding to the $N^{th}$ frame, the synchronization signal generator 110 may output the gate control signal CONT1 and the data control signal CONT2 in synchronization with the vertical synchronization signal Vsync, and the data generator 120 may store the image data signal DAT corresponding to the $N^{th}$ frame in the storage unit 130 while outputting the image data signal DAT corresponding to the $N^{th}$ frame, for example.

The gate driver 200 sequentially applies the second gate signal to the gate lines SL1 to SLn in response to the gate control signal CONT1 (i.e., the second frequency gate control signal) outputted in synchronization with the vertical synchronization signal Vsync. The data driver 300 sequentially applies a data voltage corresponds to the image data signal DAT of the $N^{th}$ frame to the data lines DL1 to DLm in response to the data control signal CONT2 (i.e., the second frequency data control signal) outputted in synchronization with the vertical synchronization signal Vsync. Accordingly, an image of the $N^{th}$ frame may be displayed on the display unit 600 during an F2 period. An image of the $(N-1)^{th}$ frame is displayed during the F1 period preceding the F2 period, and a blank period BK in which no data is written may be positioned between the F1 period and the F2 period. During the blank period BK, the display of the image by the previously written data may be maintained. In an exemplary embodiment, the blank period BK may be a period during which the previously written data is reset.

As the time for processing the raw data corresponding to the $(N+1)^{th}$ frame becomes longer, the vertical synchronization signal Vsync is not inputted from the graphics processing unit 800 at the end of a reference period RP depending on a predetermined frame frequency. When the vertical synchronization signal Vsync is not input again from a time when the vertical synchronization signal Vsync is inputted from the graphics processing unit 800 to a time when the reference period RP is ended, the synchronization signal generator 110 outputs the self-vertical synchronization signal Vsync' to the data generator 120 at the time when the reference period RP is ended. The synchronization signal generator 110 outputs the first frequency gate control signal and the first frequency data control signal. The data generator 120 outputs the image data signal DAT corresponding to the $N^{th}$ frame stored in the storage unit 130 in response to the self-vertical synchronization signal Vsync'.

The gate driver 200 sequentially applies the first gate signal to the gate lines SL1 to SLn in response to the gate control signal CONT1 (i.e., the first frequency gate control signal) outputted in synchronization with the self-vertical synchronization signal Vsync'. The data driver 300 sequentially applies a data voltage corresponds to the image data signal DAT of the $N^{th}$ frame to the data lines DL1 to DLm in response to the data control signal CONT2 (i.e., the first frequency data control signal) outputted in synchronization with the self-vertical synchronization signal Vsync'. Accordingly, an image corresponding to the $N^{th}$ frame may be displayed on the display unit 600 during an F3 period. That is, the image corresponding to the $N^{th}$ frame may be displayed again during the F3 period depending on a predetermined frame frequency after being displayed during the F2 period.

The synchronization signal generator 110 may output the self-vertical synchronization signal Vsync' to the data generator 120, may output the first frequency gate control signal to the gate driver 200, and may output the first frequency data control signal to the data driver 300 every reference period RP until the vertical synchronization signal Vsync is inputted from the graphics processing unit 800. The data generator 120 outputs the image data signal DAT corresponding to the $N^{th}$ frame stored in the storage unit 130 in response to the self-vertical synchronization signal Vsync', to the data driver 300. Accordingly, the image of the $N^{th}$ frame may be repeatedly displayed at a predetermined frame frequency until the vertical synchronization signal Vsync is inputted from the graphics processing unit 800 to the signal controller 100. Blank periods BK are positioned between adjacent images, and lengths of each of the blank periods BK may be the same.

During an F4 period, the vertical synchronization signal Vsync is inputted from the graphics processing unit 800 to the synchronization signal generator 110 while the data voltage depending on the image data signal DAT corresponding to the $N^{th}$ frame is sequentially inputted to the display unit 600 in a scanning direction (e.g., vertical direction in FIG. 1) from the pixels connected to the first gate line SL1 in accordance with the self-vertical synchronization signal Vsync'. Then, the image signal ImS corresponding to the $(N+1)^{th}$ frame is inputted to the data generator 120. The synchronization signal generator 110 transfers the vertical synchronization signal Vsync to the data generator 120, and outputs the gate control signal CONT1 (i.e., the second frequency gate control signal) and the data control signal CONT2 (i.e., the second frequency data control signal) in synchronization with the vertical synchronization signal Vsync. The data generator 120 may process the image signal ImS inputted together with the vertical synchronization signal Vsync to output the image data signal DAT corresponding to the $(N+1)^{th}$ frame to the data driver 300. In this case, the data generator 120 may store the image data signal DAT corresponding to the $(N+1)^{th}$ frame in the storage unit 130.

The gate driver 200 stops the output of the first gate signal when the second frequency gate control signal is inputted while sequentially outputting the first gate signal to the gate lines SL1 to SLn in response to the first frequency gate control signal. That is, the output of the first gate signal may be stopped after the first gate signal is outputted to some of the gate lines SL1 to SLn. The gate driver 200 may sequentially output the second gate signal to the gate lines SL1 to SLn in response to the second frequency gate control signal.

The data driver 300 stops the output of the first data voltage when the second frequency data control signal is inputted while outputting the first data voltage to the data lines DL1 to DLm in response to the first frequency data control signal. That is, the input of the first data voltage may be stopped after the first data voltage is inputted into some of the pixels included in the display unit 600. The data driver 300 may output the second data voltage to the data lines DL1 to DLm in response to the second frequency data control signal. In this case, the first data voltage may be a data voltage corresponding to the $N^{th}$ frame, and the second data voltage may be a data voltage corresponding to the $(N+1)^{th}$ frame. The second data voltage may be the data voltage corresponding to the current frame, and the first data voltage may be the data voltage corresponding to the previous frame. That is, a portion of the image from the first gate line SL1 to a predetermined gate line among the image of the previous frame may be displayed on the display unit 600, and then the image of the current frame may be displayed. A part of an image of the previous frame and an image of the current frame are continuously displayed, and no blank period BK is positioned between the part of the previous frame and the image of the current frame. Accordingly, the F4 period may be longer than the F2 period or the F3 period.

A range in which the image of the previous frame is partially displayed may correspond to a difference PD between output times of the self-vertical synchronization signal Vsync' and the vertical synchronization signal Vsync which are temporally adjacent to each other. The difference PD between the output times of the self-vertical synchronization signal Vsync' and the vertical synchronization signal Vsync is smaller than the reference period RP corresponding to the predetermined frame frequency. The difference PD between the output times of the self-vertical synchronization signal Vsync' and the vertical synchronization signal Vsync may be smaller than the period for displaying one image (e.g., the F2 period or the F3 period).

When the vertical synchronization signal Vsync is not input again from the time when the vertical synchronization signal Vsync is inputted to the time when the reference period RP is ended during the F4 period, the synchronization signal generator 110 outputs the self-vertical synchronization signal Vsync', the first frequency gate control signal, and the first frequency data control signal at the time when the reference period RP is ended. The data generator 120 outputs the image data signal DAT corresponding to the $(N+1)^{th}$ frame stored in the storage unit 130. Accordingly, an image corresponding to the $(N+1)^{th}$ frame in an F5 period may be displayed on the display unit 600.

Hereinafter, an exemplary embodiment of a pixel will be described with reference to FIG. 4. In the exemplary embodiment of FIG. 4, a pixel of the OLED display is taken as an example, but a configuration and kind of the pixel are not limited thereto.

Figure 4:
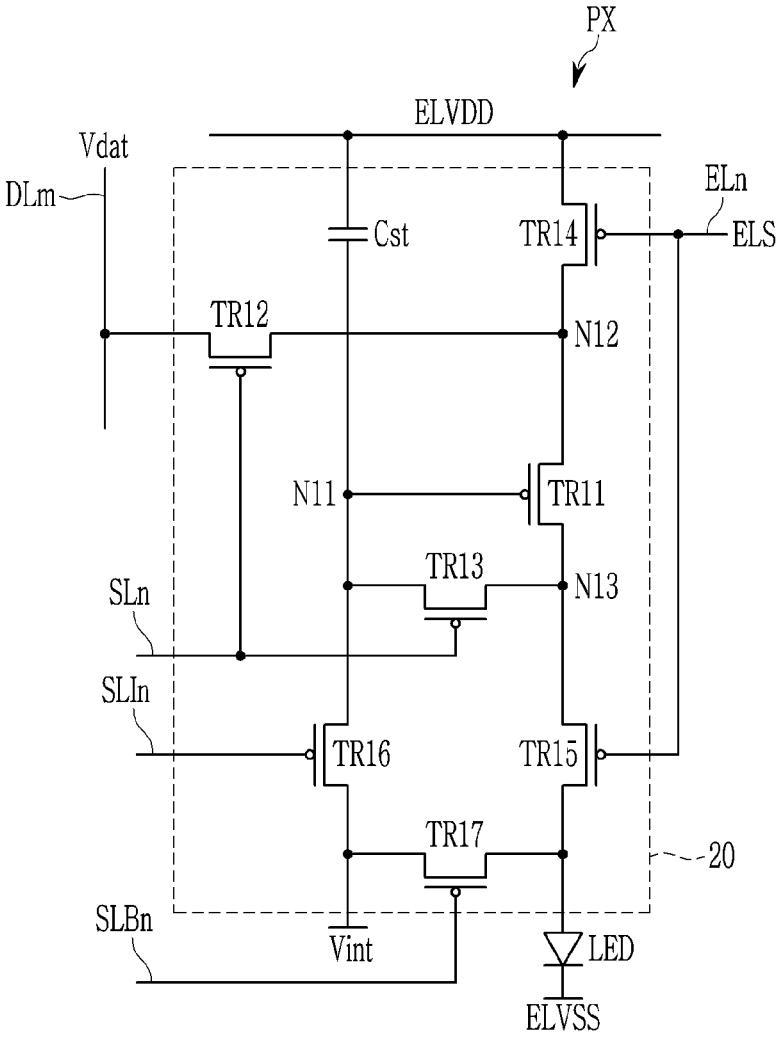
FIG. 4 illustrates an exemplary embodiment of a pixel of a display device.

FIG. 4 illustrates an exemplary embodiment of a pixel of a display device. A pixel PX disposed in an $n^{th}$ pixel row and an $m^{th}$ pixel column among the pixels PX included in the display device of FIG. 1 will be described as an example.

Referring to FIG. 4, the pixel PX includes a light emitting diode LED and a pixel circuit 20 for controlling a current flowing from the first power supply voltage ELVDD to the light emitting diode LED. A first gate line SLn, a second gate line SLIn, a third gate line SLBn, a data line DLm, and an emission control line ELn may be connected to the pixel circuit 20. The second gate line SLIn may be a gate line to which a gate-on voltage is applied one horizontal period earlier than the first gate line SLn. One horizontal period may correspond to one horizontal synchronization signal Hsync. The third gate line SLBn is a gate line to which a gate-on voltage is applied one horizontal period earlier than the second gate line SLIn, a gate line to which a gate-on voltage is applied simultaneously with the second gate line SLIn, or a gate line to which a gate-on voltage is applied simultaneously with the first gate line SLn.

The pixel circuit 20 may include a driving transistor TR11, a switching transistor TR12, a compensation transistor TR13, a first emission control transistor TR14, a second emission control transistor TR15, an initialization transistor TR16, a reset transistor TR17, and a storage capacitor Cst.

The driving transistor TR11 includes a gate electrode connected to a first node N11, a first electrode connected to a second node N12, and a second electrode connected to a third node N13. The driving transistor TR11 is connected between the first power supply voltage ELVDD and the light emitting diode LED. The driving transistor TR11 controls an amount of a current flowing from the first power supply voltage ELVDD to the light emitting diode LED corresponding to a voltage of the first node N11.

The first power supply voltage ELVDD may be a high-level voltage supplied to an anode of the light emitting diode LED.

The switching transistor TR12 includes a gate electrode connected to the first gate line SLn, a first electrode coupled to the data line DLm, and a second electrode coupled to the second node N12. The switching transistor TR12 is connected between the data line DLm and the driving transistor TR11. The switching transistor TR12 is turned on depending on the gate signal of the gate-on voltage applied to the first gate line SLn and transfers a data voltage Vdat applied to the data line DLm to the second node N12.

The compensation transistor TR13 includes a gate electrode connected to the first gate line SLn, a first electrode connected to the third node N13, and a second electrode connected to the first node N11. The compensation transistor TR13 is connected between the second electrode and the gate electrode of the driving transistor TR11, and is turned on depending on the gate signal of the gate-on voltage applied to the first gate line SLn. The driving transistor TR11 is diode-connected by the compensation transistor TR13 so that a threshold voltage of the driving transistor TR11 is compensated. A data voltage compensating the threshold voltage of the driving transistor TR11 is transferred to the first node N11.

The first emission control transistor TR14 includes a gate electrode connected to the emission control line ELn, a first electrode connected to the first power supply voltage ELVDD, and a second electrode connected to the second node N12. The first emission control transistor TR14 is connected between the first power supply voltage ELVDD and the driving transistor TR11. The first emission control transistor TR14 is turned on depending on the emission signal ELS of the gate-on voltage applied to the emission control line ELn and transfers the first power supply voltage ELVDD to the driving transistor TR11.

The second emission control transistor TR15 includes a gate electrode connected to the emission control line ELn, a first electrode connected to the third node N13, and a second electrode connected to the anode of the light emitting diode LED. The second emission control transistor TR15 is connected between the driving transistor TR11 and the light emitting diode LED. The second emission control transistor TR15 is turned on depending on the emission signal ELS of the gate-on voltage applied to the emission control line ELn and transfers a current flowing through the driving transistor TR11 to the light emitting diode LED.

The initialization transistor TR16 includes a gate electrode connected to the second gate line SLIn, a first electrode connected to the initialization voltage Vint, and a second electrode connected to the first node N11. The initialization transistor TR16 is connected between the gate electrode of the driving transistor TR11 and the initialization voltage Vint. The initialization transistor TR16 is turned on by the gate signal of the gate-on voltage applied to the second gate line SLIn. The initialization transistor TR16 may transfer the initialization voltage Vint to the first node N11 to initialize the gate voltage of the driving transistor TR11 with the initialization voltage Vint. The initialization voltage Vint, which is for initializing or resetting the pixel PX, may be a different voltage from the second power supply voltage ELVSS.

The reset transistor TR17 includes a gate electrode connected to the third gate line SLBn, a first electrode connected to the initialization voltage Vint, and a second electrode connected to the anode of the light emitting diode LED. The reset transistor TR17 is connected between the anode electrode of the light emitting diode LED and the initialization voltage Vint, The reset transistor TR17 is turned on by the gate signal of the gate-on voltage applied to the third gate line SLBn. The reset transistor TR17 may transfer the initialization voltage Vint to the anode electrode of the light emitting diode LED to reset the light emitting diode LED with the initialization voltage Vint. In another exemplary embodiment, the reset transistor TR17 may be omitted.

In an exemplary embodiment, the driving transistor TR11, the switching transistor TR12, the compensation transistor TR13, the first emission control transistor TR14, the second emission control transistor TR15, the initialization transistor TR16, and the reset transistor TR17 may be p-channel field effect transistors. A gate-on voltage for turning on the p-channel field-effect transistors is a low-level voltage, and a gate-off voltage for turning off the p-channel field-effect transistors is a high-level voltage.

In another exemplary embodiment, at least one of the driving transistor TR11, the switching transistor TR12, the compensation transistor TR13, the first emission control transistor TR14, the second emission control transistor TR15, the initialization transistor TR16, and the reset transistor TR17 may be n-channel field effect transistors. A gate-on voltage for turning on the n-channel field-effect transistors is a high-level voltage, and a gate-off voltage for turning off the n-channel field-effect transistors is a low-level voltage.

The storage capacitor Cst includes a first electrode connected to the first power supply voltage ELVDD and a second electrode connected to the first node N11. The data voltage compensating the threshold voltage of the driving transistor TR11 is transferred to the first node N11, and the storage capacitor Cst serves to maintain the voltage of the first node N11.

The light emitting diode LED includes an anode connected to the second electrode of the second emission control transistor TR15 and a cathode connected to the second power supply voltage ELVSS. The second power supply voltage ELVSS may be a low-level voltage supplied to the cathode of the light emitting diode LED. The light emitting diode LED may be connected between the pixel circuit 20 and the second power supply voltage ELVSS to emit light with a luminance corresponding to a current supplied from the pixel circuit 20. The light emitting diode LED may include an emission layer including at least one of an organic emission material and an inorganic emission material. Holes and electrons are injected from the anode and the cathode into the emission layer, and excitons formed by combining the injected holes and electrons are emitted when they fall from an excited state to a ground state. In an exemplary embodiment, the light emitting diode LED may emit light of one of primary colors or white light, for example. Examples of the primary colors may include three primary colors of red, green, and blue. Other examples of the primary colors include yellow, cyan, and magenta.

Hereinafter, a comparative example of a driving method of a display device will be described with reference to FIG. 5, and a luminance variation that may occur when driving the display device according to the driving method of FIG. 5 will be described with reference to FIG. 6.

Figure 5:
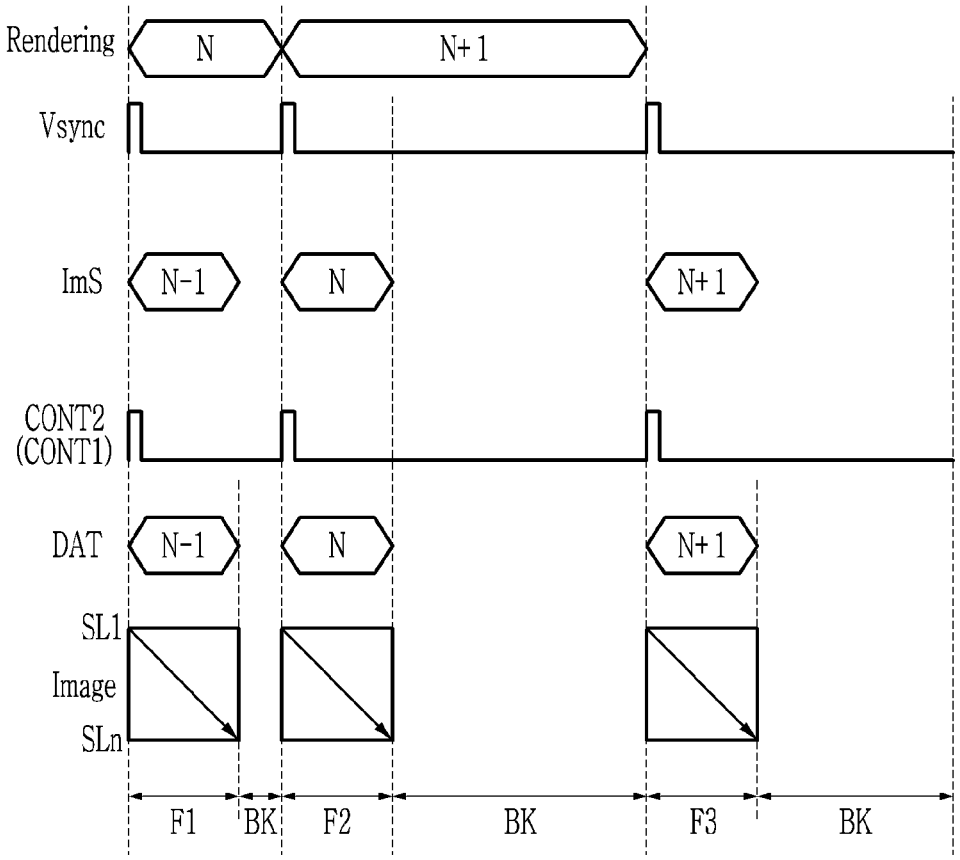
FIG. 5 is a timing diagram showing a comparative example of a driving method of a display device.

FIG. 5 is a timing diagram showing a comparative example of a driving method of a display device. A difference from the exemplary embodiment of the driving method of the display device according to the invention illustrated in FIG. 3 will be mainly described.

Referring to FIG. 5, a frame frequency of an image displayed when a frame frequency is varied depending on a rendering time is also changed. In an exemplary embodiment, as a time for processing raw data corresponding to the $(N+1)^{th}$ frame becomes longer, an image is displayed depending on the image signal ImS corresponding to the $N^{th}$ frame, and then the blank period BK until the image signal ImS corresponding to the $(N+1)^{th}$ frame is inputted becomes longer, and the frame frequency at which the image is displayed becomes lower, for example. That is, a blank period (e.g., between the F2 period and the F3 period) when an image is displayed at a lower frame frequency becomes longer than a blank period (e.g., between the F1 period and the F2 period) when an image is displayed at a high frame frequency. As the blank period becomes longer, the luminance of the image generally becomes lower. This will be described with reference to the experimental example of FIG. 6.

Figure 6:
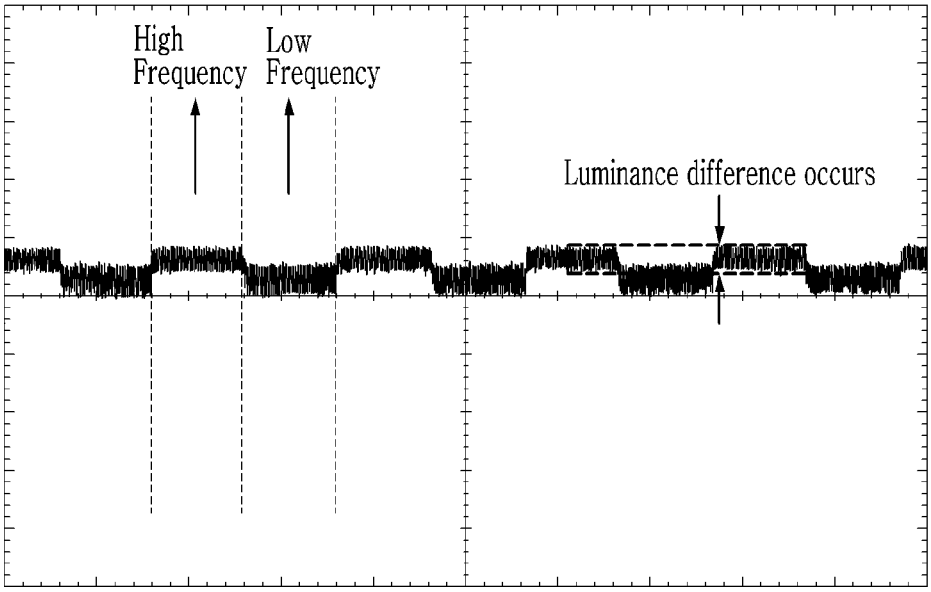
FIG. 6 illustrates an experimental example showing luminance variation of an image displayed when the display device is driven according to the comparative example of the driving method of FIG. 5.

FIG. 6 illustrates an experimental example showing luminance variation of an image displayed when the display device is driven according to the driving method of FIG. 5.

The luminance of an image that is displayed at a high frame frequency was measured, and the luminance of an image that is displayed at a low frame frequency was measured, and these results are shown in FIG. 6. As a result, it is seen that the luminance of the image that is displayed at the low frame frequency is lower than that of the image that is displayed at the high frame frequency. Accordingly, when the frame frequency fluctuates, the luminance of the image changes, and thus the screen may appear to be flickering.

However, as described above with reference to FIGS. 1 to 3, even when the frame frequency of the image signal ImS received from the graphics processing unit 800 varies, the image displayed on the display unit 600 is displayed at a predetermined frame frequency, and thus it is possible to prevent the luminance fluctuation that may occur according to the variation of the frame frequency, thereby improving the display quality of the display device.

While exemplary embodiments of the invention have been particularly shown and described with reference to the accompanying drawings, the specific terms used herein are only for the purpose of describing the invention and are not intended to define the meanings thereof or be limiting of the scope of the invention set forth in the claims. Therefore, those skilled in the art will understand that various modifications and other equivalent embodiments of the invention are possible. Consequently, the true technical protective scope of the invention must be determined based on the technical spirit of the appended claims.

What is claimed is:

1. A display device comprising:

a display unit which includes a plurality of pixels and a plurality of gate lines and a plurality of data lines connected to the plurality of pixels;

a data driver connected to the plurality of data lines;

a graphics processing unit which generates a vertical synchronization signal; and a signal controller which outputs a first frequency data control signal to the data driver at a predetermined frame frequency and outputs a second frequency data control signal to the data driver in synchronization with the vertical synchronization signal received from the graphics processing unit, wherein the data driver outputs a first data voltage to the plurality of data lines in accordance with the first frequency data control signal, and stops the output of the first data voltage and outputs a second data voltage to the plurality of data lines when the second frequency data control signal is inputted while the first data voltage is output to the plurality of data lines, and a blank period in which no data is written is not positioned between display of a part of an image of a previous frame and display of an image of a current frame, and the part of the image of the previous frame and the image of the current frame are continuously displayed.

2. The display device of claim 1, wherein the predetermined frame frequency is a highest frame frequency among variable frame frequencies.

3. The display device of claim 1, wherein the first data voltage is a data voltage corresponding to the previous frame, and the second data voltage is a data voltage corresponding to the current frame.

4. The display device of claim 3, wherein the display unit displays the part of the image of the previous frame by the first data voltage, and then displays the image of the current frame by the second data voltage.

5. The display device of claim 1, further comprising a gate driver connected to the plurality of gate lines, wherein the signal controller outputs a first frequency gate control signal to the gate driver at a predetermined frame frequency and outputs a second frequency gate control signal to the gate driver in synchronization with the vertical synchronization signal received from the graphics processing unit, and the gate driver outputs a first gate signal to the plurality of gate lines in accordance with the first frequency gate control signal, and stops the output of the first gate signal and outputs a second gate signal to the plurality of gate lines when the second frequency gate control signal is inputted while the first gate signal is output to the plurality of gate lines.

6. A display device comprising:

a display unit comprising a plurality of pixels and a plurality of gate lines and a plurality of data lines connected to the plurality of pixels;

a data driver connected to the plurality of data lines;

a synchronization signal generator which outputs a first frequency data control signal to the data driver at a predetermined frame frequency, outputs a second frequency data control signal to the data driver in synchronization with a vertical synchronization signal received from a graphics processing unit, and generates a self-vertical synchronization signal at the predetermined frame frequency;

a data generator which receives the vertical synchronization signal and the self-vertical synchronization signal from the synchronization signal generator, processes an image signal received from the graphics processing unit to generate an image data signal, and transfers the image data signal to the data driver; and a storage unit which stores the image data signal, wherein the data generator outputs an image data signal of a previous frame stored in the storage unit in synchronization with the vertical synchronization signal, and outputs an image data signal of a current frame in synchronization with the vertical synchronization signal, and a difference between an output time of the self-vertical synchronization signal and an output time of the vertical synchronization signal is smaller than a reference period in accordance with the predetermined frame frequency, and a blank period in which no data is written is not positioned between display of a part of an image of the previous frame and display of an image of the current frame, and the part of the image of the previous frame and the image of the current frame are continuously displayed.

7. The display device of claim 6, wherein the predetermined frame frequency is a highest frame frequency among variable frame frequencies.

8. The display device of claim 6, wherein the synchronization signal generator generates the self-vertical synchronization signal with the predetermined frame frequency when the vertical synchronization signal is received at a frame frequency which is lower than the predetermined frame frequency.

9. The display device of claim 6, wherein the data driver outputs a first data voltage to the plurality of data lines in accordance with the first frequency data control signal, and stops the output of the first data voltage and outputs a second data voltage to the plurality of data lines when the second frequency data control signal is inputted while the first data voltage is output to the plurality of data lines.

10. The display device of claim 9, wherein the first data voltage is a data voltage corresponding to the previous frame, and the second data voltage is a data voltage corresponding to the current frame.

11. The display device of claim 10, wherein the display unit displays a part of the image of the previous frame by the first data voltage, and then displays the image of the current frame by the second data voltage.

12. The display device of claim 6, further comprising a gate driver connected to the plurality of gate lines, wherein the signal controller outputs a first frequency gate control signal to the gate driver at a predetermined frame frequency and outputs a second frequency gate control signal to the gate driver in synchronization with the vertical synchronization signal received from the graphics processing unit, and the gate driver outputs a first gate signal to the plurality of gate lines in accordance with the first frequency gate control signal, and stops the output of the first gate signal and outputs a second gate signal to the plurality of gate lines when the second frequency gate control signal is inputted while the first gate signal is output to the plurality of gate lines.

13. A driving method of a display device including a display unit which includes a plurality of pixels and a plurality of gate lines and a plurality of data lines connected to the plurality of pixels, the method comprising:

allowing an image of a previous frame to be repeatedly displayed on the display unit at a predetermined frame frequency until a vertical synchronization signal is inputted from a graphics processing unit; and displaying an image of a current frame on the display unit in synchronization with the vertical synchronization signal after displaying a part of the image of the previous frame from a first gate line of the plurality of gate lines to a predetermined gate line of the plurality of gate lines, wherein a blank period in which no data is written is not positioned between display of the part of the image of the previous frame and display of the image of the current frame, and the part of the image of the previous frame and the image of the current frame are continuously displayed.

14. The driving method of claim 13, wherein the vertical synchronization signal is received at a frame frequency which is lower than the predetermined frame frequency.

15. The driving method of claim 13, wherein the predetermined frame frequency is a highest frame frequency among variable frame frequencies.

16. The driving method of claim 13, wherein the allowing the image of the previous frame to be displayed on the display unit includes:

generating a self-vertical synchronization signal at the predetermined frame frequency; and outputting an image data signal of the previous frame stored in a storage unit in synchronization with the self-vertical synchronization signal.

17. The driving method of claim 13, wherein a first frequency data control signal is applied to a data driver connected to the plurality of data lines at the predetermined frame frequency, and the data driver outputs a first data voltage in accordance with the first frequency data control signal, and the data driver stops output of the first data voltage and outputs a second data voltage to the plurality of data lines to display the image of the current frame when a second frequency data control signal synchronized with the vertical synchronization signal is applied to the data driver while outputting the first data voltage to the plurality of data lines.

* * * * *